US005800046A

United States Patent [19]

Lin

[11] Patent Number: 5,800,046

[45] Date of Patent: Sep. 1, 1998

[54] LIT STRING STRUCTURE FOR EASY FORMATION OF PATTERNS

[75] Inventor: Lindbergh Lin, Taipei, Taiwan

[73] Assignee: Studio Eluceo Ltd., Taipei, Taiwan

[21] Appl. No.: 911,014

[22] Filed: Aug. 14, 1997

[51] Int. Cl.[6] ..... F21P 1/00

[52] U.S. Cl. ..... 362/252; 362/249; 362/396; 362/391; 362/806

[58] Field of Search ..... 362/249, 252, 362/396, 806, 123, 239, 391, 812

[56] References Cited

U.S. PATENT DOCUMENTS

| | | | |
|---|---|---|---|
| 5,526,246 | 6/1996 | Liou | 362/252 |
| 5,669,707 | 9/1997 | Huang | 362/249 |
| 5,709,462 | 1/1998 | Rumpel | 362/249 |

*Primary Examiner*—Stephen F. Husar

*Attorney, Agent, or Firm*—Beveridge, DeGrandi, Weilacher & Young LLP

[57] ABSTRACT

Disclosed is a lit string structure for easy formation of patterns mainly including at least one set of lit string and a foldable net. The lit string is fixed onto the net by binding each lamp holder on the lit string to strings forming the net. The lamp holder is provided with binding means for retaining electric wires of the lit string and strings of the net to the lamp holder and thereby easily associates the lit string with the net. Whereby, more than one lit string can be attached to the net to form different kinds of light sculptures. When the lit string is not in use, it along with the net can be folded into a very small volume for packing, transportation, and storage. The lit string on the net can be freely located on a wall surface, a door, a window, or in a garden or on a roof.

9 Claims, 8 Drawing Sheets

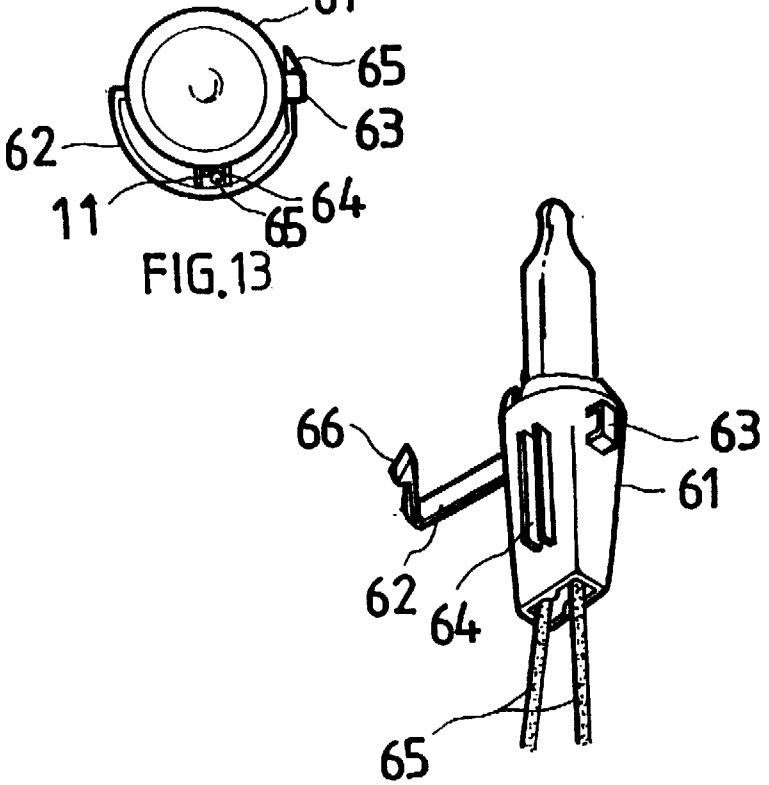
FIG.13
FIG. 12
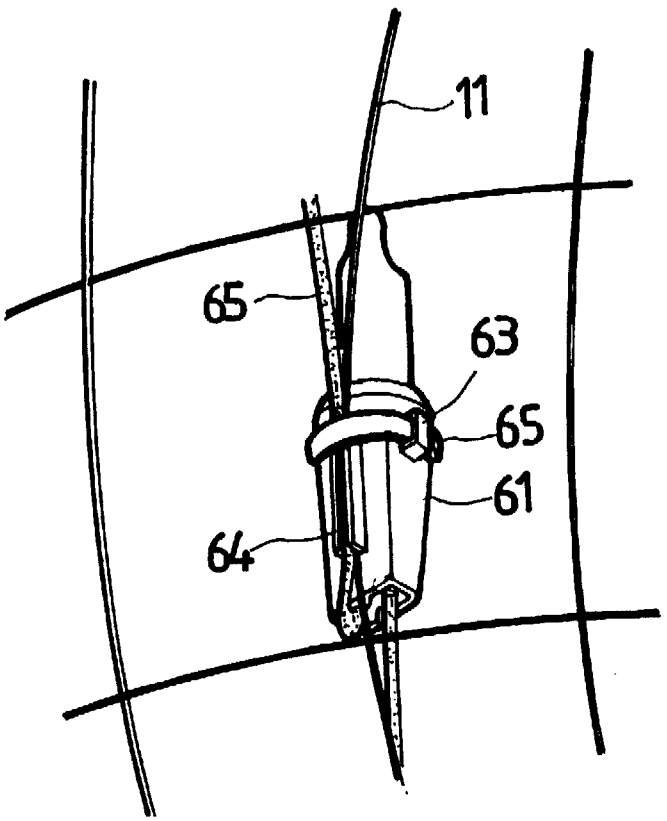
FIG. 11

LIT STRING STRUCTURE FOR EASY FORMATION OF PATTERNS

FIELD OF THE INVENTION

The present invention relates to a lit string structure for easy formation of patterns, and more particularly to a decorative light-emitting structure which is suitable for use as advertising means and/or a seasonal decoration, such as Christmas.

BACKGROUND OF THE INVENTION

A lit string, due to its highlighting effect, is widely used in our life in many different manners. For example, it can be used as a good Christmas decoration or an eye-catching advertisement in the night.

A conventional lit string structure usually includes a plurality of lamp holders serially connected via electric wires. By taking advantage of a flexibility of the electric wires connecting the lamp holders, the whole lit string can be hung on a wall or tree. However, the conventional lit string can not be used to form somewhat complicate designs.

There are attempts made to overcome this drawback. As shown in FIGS. 1 and 2, a lit string 91 with lamps 93 is extended through a transparent hose 92 which is then bent or wound to form a design, a pattern, or a figure. The drawbacks existing in this type of lit string structure include:

(1) Any replacement of a burned lamp 93 would have to pull the lit string out of the hose and then push the repaired lit string into the hose again. It is very uneasy to do so;

(2) The hose 92 has only limited supporting strength and can be used to form a small-scaled design requiring a limited length of hose;

(3) Additional supporting bars 94 are needed to reinforce the design formed from the bent and/or wound hose 92. These supporting bars 94 are usually elongated metal bars which can not be conveniently packed and transported;

(4) The lit string 91, the hose 92, and the supporting bars 94 together occupy a large storage space when the lit string 91 is not in use; and (5) This type of lit string requires high costs to manufacture, pack, store, transport, and distribute it due to a large volume thereof, resulting in unnecessary waste of valuable space and labour for handling it.

FIG. 3 illustrates another conventional lit string structure in which a lit string 96 is fixed to a rigid framework 95 by winding the lit string 96 round the framework 95. The framework 95 can be formed to a certain desired figure or pattern in advance. In securing the lit string 96 onto the rigid framework 95, additional means, such as a string 97 or other fastening means is required to achieve this purpose. This is, of course, very inconvenient. Moreover, the framework 95 must be fixedly mounted on a ground and is therefore only suitable for use outdoors, such as in a garden, and can not be attached to a door, window, or ceiling. What is more confusing is such framework 95 occupies a considerable room for storage when it is not in use and it is not convenient for packing and transport, either.

SUMMARY OF THE INVENTION

It is therefore a primary object of the present invention to provide a lit string structure for easy formation of designs or patterns. The lit string structure according to the present invention mainly includes at least one set of lit string and a foldable net. Lamp holders in the lit strings are secured to the net according to a predetermined design. Each lamp holder in the lit strings is provided with means for holding an electric wire and a length of string forming a part of the net, so that each lamp holder may be conveniently associated with the net at a certain point. This arrangement may achieve a light sculpture effect. Moreover, the lit strings together with the net can be folded into a very small volume for convenient packing, transportation, and storage.

Another object of the present invention is to provide a lit string structure for easy formation of designs or patterns in which each lamp holder in the lit strings is provided with a binding means, so that the lamp holder can be quickly secured to a net to lower labor cost required to form a design or pattern on the net.

A further object of the present invention is to provide a lit string structure for easy formation of designs or patterns in which each lit string associated with the net is open for access. Any burned lamp on the lit strings can be easily replaced with a new one.

A still further object of the present invention is to provide a lit string structure for easy formation of designs or patterns which can be freely used indoors by mounting the net to a door leaf, a window, a wall surface, or a ceiling, or outdoors in a garden or one a roof by supporting the net with two rigid posts.

BRIEF DESCRIPTION OF THE DRAWINGS

FIG. 11 is still another enlarged, fragmentary, perspective rear view of FIG. 4 showing the lamp holder in the lit string being associated with the net in a third manner;

FIG. 12 is an enlarged, fragmentary, perspective view showing the lamp holder of FIG. 11 before being attached to the net;

FIG. 13 is a top view of the lamp holder of FIG. 11; and

DETAILED DESCRIPTION OF THE PREFERRED EMBODIMENTS

Figure 1:
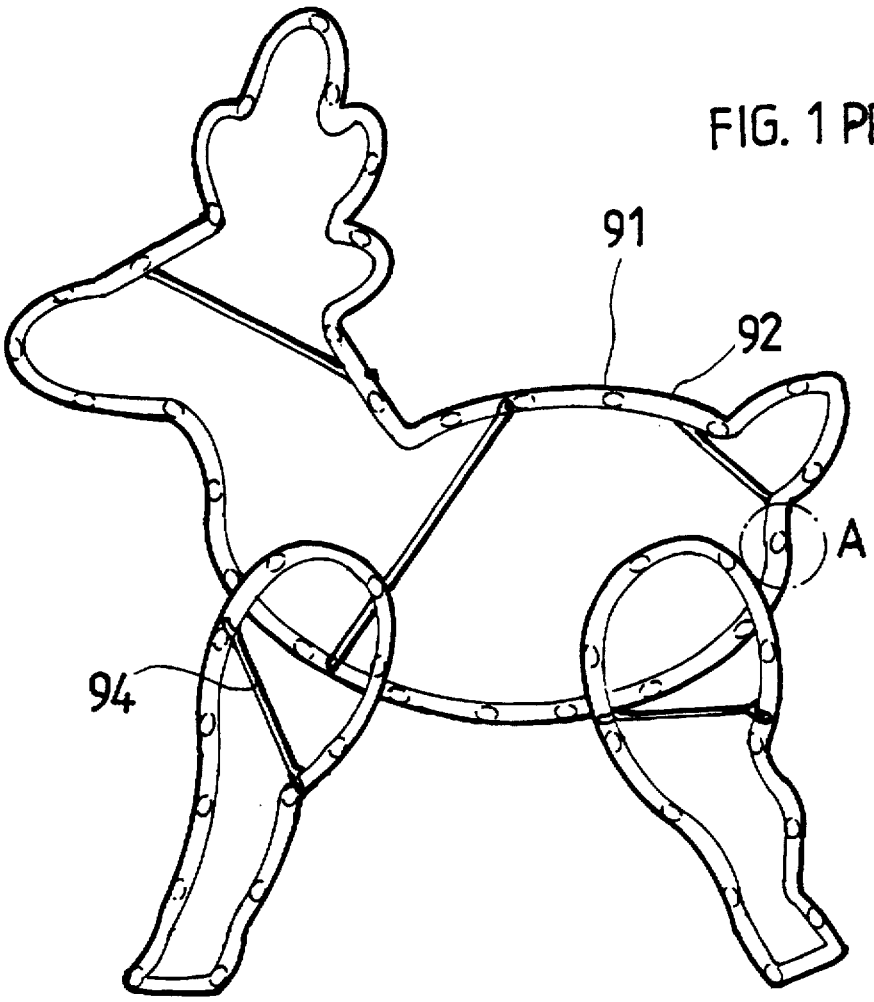
FIG. 1 PRIOR ART
FIG. 1 shows a design formed from a conventional lit string extended through a transparent hose.
Figure 2:
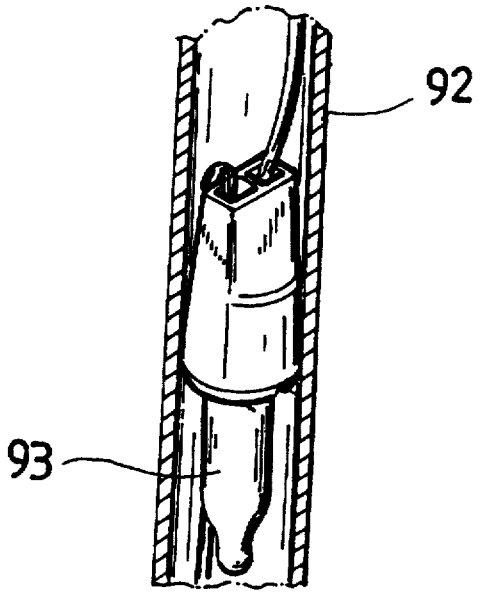
FIG. 2 PRIOR ART
FIG. 2 is a fragmentary, enlarged, sectional view taken on Part A of FIG. 1.
Figure 3:
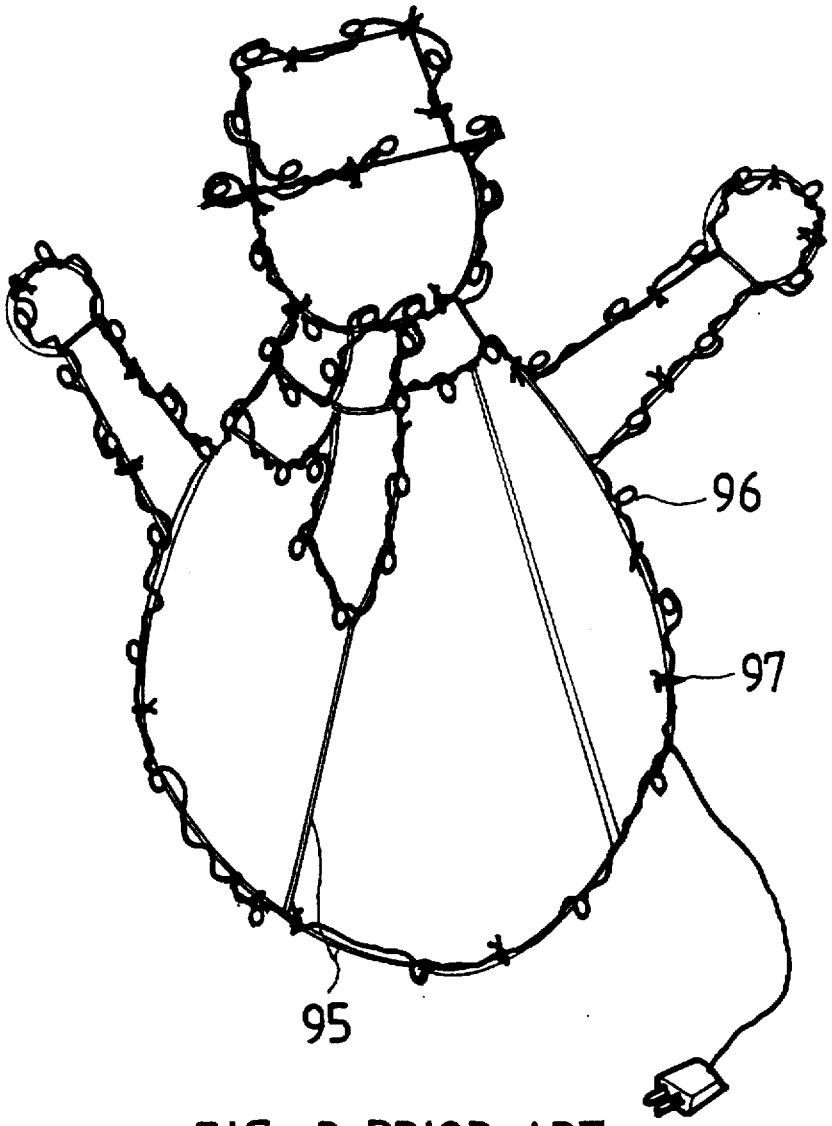
FIG. 3 PRIOR ART
FIG. 3 shows a design formed from another conventional lit string wound round a framework.
Figure 4:
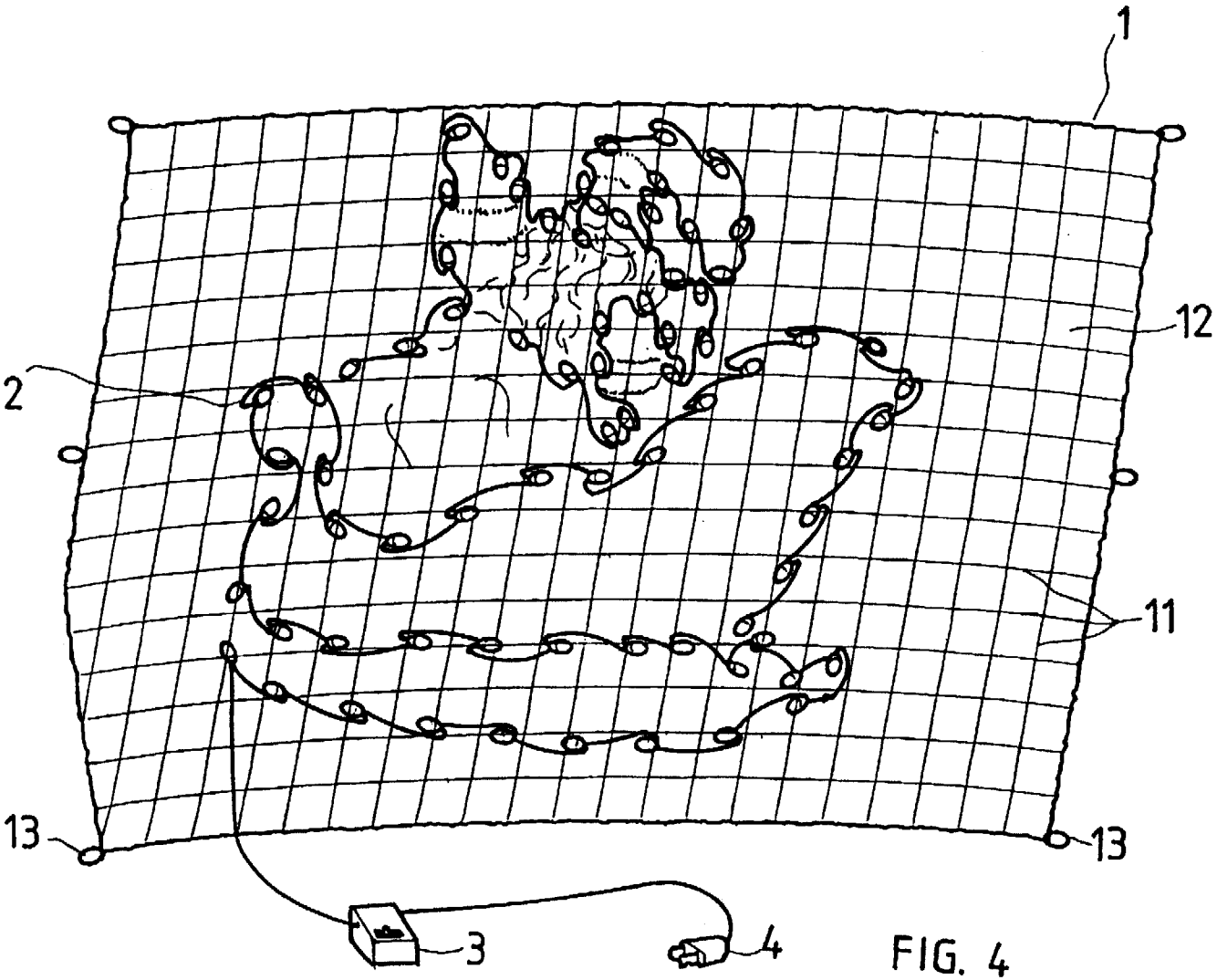
FIG. 4 shows a design formed from the lit string and the net according to the present invention.

Please refer to FIG. 4 which shows a pattern formed from a lit string attached to a net according to the present invention. As shown, the present invention relates to a lit string structure including a foldable net 1, at least one set of lit string 2, a control box 3, and a plug 4.

The net 1 can be woven from textile or plastic material and includes a plurality of net strings 11 and a plurality of openings 12. The lit string 2 includes a plurality of lamp holders 21 serially connected together by means of electric wires 28. The control box 3 has a control circuit therein for controlling the lighting, extinguishing, and flashing of lamps 26 in the lit string 2. The plug 4 can be plugged into a power source socket to obtain necessary power for lightening the lamps 26.

Figure 6:
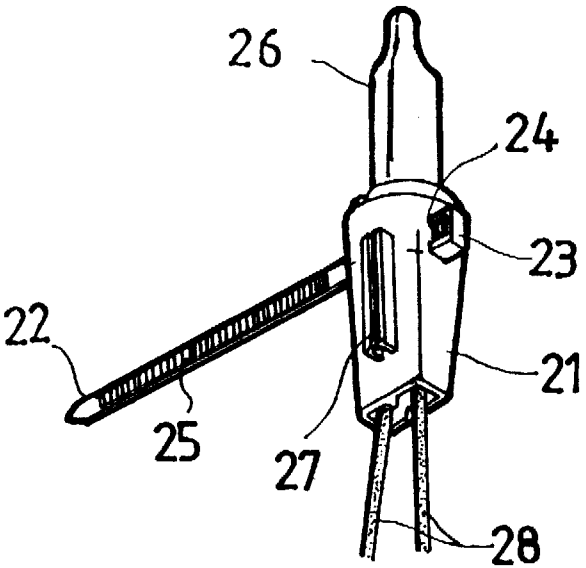
FIG. 6 is an enlarged, fragmentary, perspective view showing the lamp holder of FIG. 5 before being attached to the net.
Figure 8:
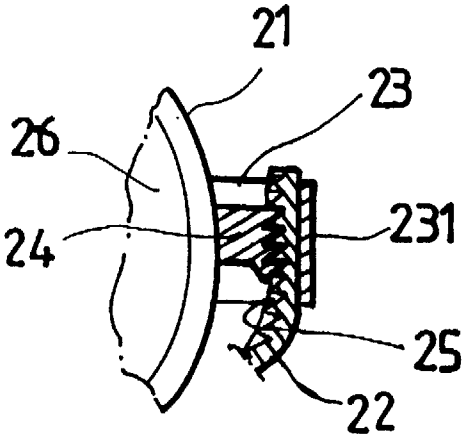
FIG. 8 is an enlarged, fragmentary, sectional view taken on line B—B of FIG. 7, showing the manner in which a binding belt is retained by a catcher provided on the lamp holder.
Figure 7:
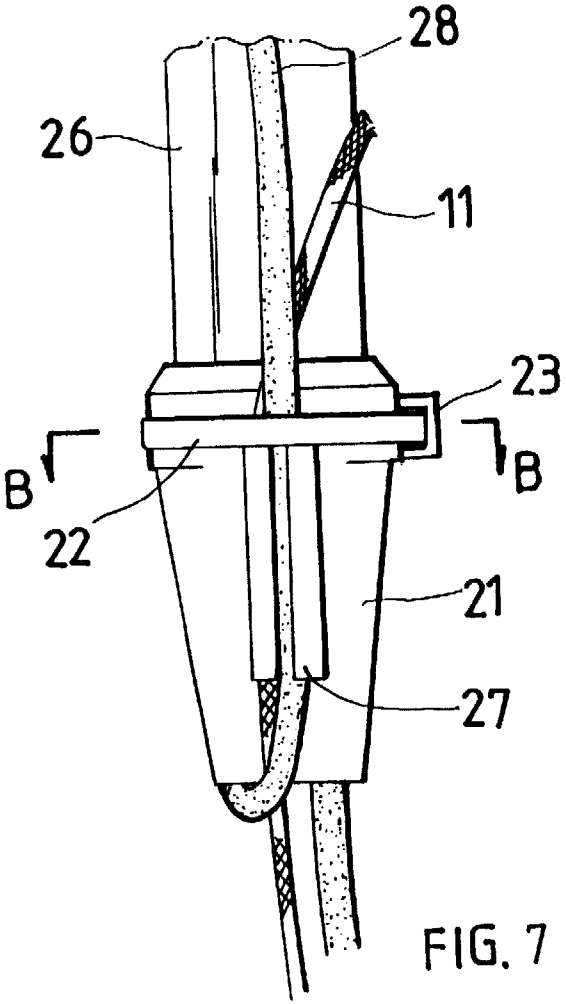
FIG. 7 is a plan view of the lamp holder of FIG. 6.

Please refer to FIG. 6. Each lamp holder 21 has a lamp 26 connected thereto and has a binding means provided on an outer surface thereof The binding means includes a long belt 22 having a toothed inner surface 25, and a catcher 23. As shown in FIG. 8, the catcher 23 has an outer wall portion 231 and a toothed block 24 formed in the catcher 23 opposite to the outer wall portion 231. The long belt 22 has one end connected to the outer surface of the lamp holder 21 and a free end of the belt 22 can be extended through the catcher 23 between the outer wall portion 231 and the toothed block 24, such that the toothed inner surface 25 of the belt 22 engages with the toothed block 24, allowing the long belt 22 to slide forward in only one direction without being pulled backward again. The lamp holder 21 is also provided on its outer surface with a clamping means 27, so that one wire 28 and a length of the net string 11 can be pushed into the clamping means 27 and be located therein, as shown in FIG. 5.

Figure 5:
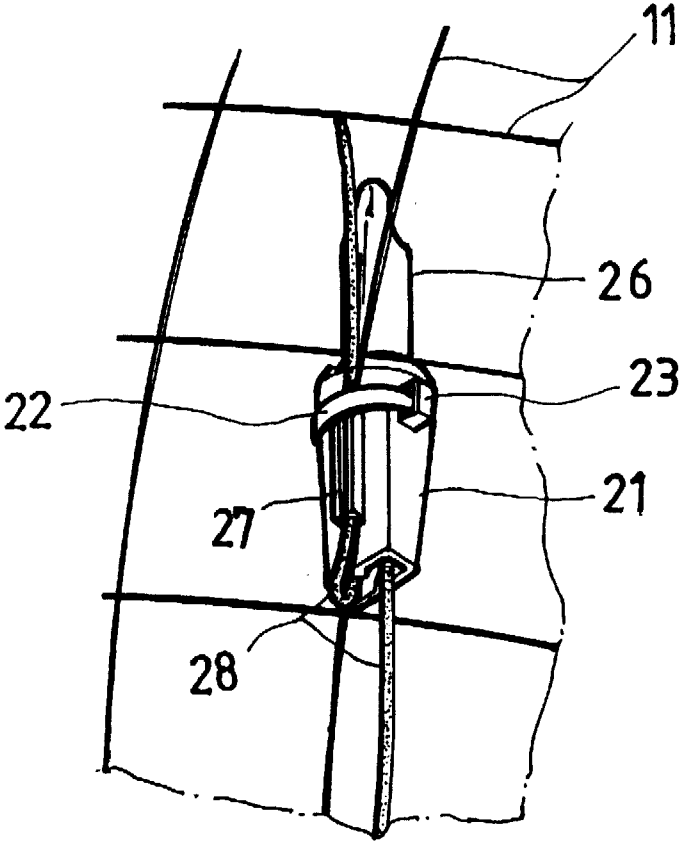
FIG. 5 is an enlarged, fragmentary, perspective rear view of FIG. 4 showing the manner in which a lamp holder in the lit string of the present invention associated with a length of string of the net.

The binding means and the clamping means 27 on the lamp holder 21 as shown in FIGS. 5 and 6 allow the lit string 2 to be very easily fixed onto the net 1. Since the lamp holder 21 is formed of plastic material by injection molding, a manufacturer needs only to modify the mold to include the binding means and the clamping means without increasing too much manufacturing cost, while the improved lamp holder can be quickly produced for easily attaching to the net 1.

An advantage of the present invention is that the design or pattern formed on the net 1 from the lit string 2 is almost unlimited in dimensions. And, more than one lit string 2 can be used to form the design or pattern while they are caused to flash at different rates and at different times, creating a more splendid sight in the night and therefore achieving a better decorative or advertising effect.

To reduce labor cost required to mount the lit string 2 on the net 1, it is desirable to print a desired design or pattern on the net 1 in advance. Then, position the lit string 2 on the net 1 by following the printed design or pattern. Finally, push the wire 28 and the net string 11 into the clamping means 27 on each lamp holder 21, and extend each long belt 22 through a corresponding catcher 23 and tighten the belt 22 against the clamping means 27 on the lamp holder 21 to confine the wire 28 and the net string 11 in the clamping means 27. Extra length of the long belt 22 beyond the catcher 23 can be cut off.

Alternatively, the lit string 2 can be positioned on a board following a desired design or pattern printed on the board in advance. If necessary, nails may be used to fix the lit string in place. Then, lay the net 1 over the board and bind the lamp holders 21 to the net 1 one by one in a manner as previously described.

Figure 10:
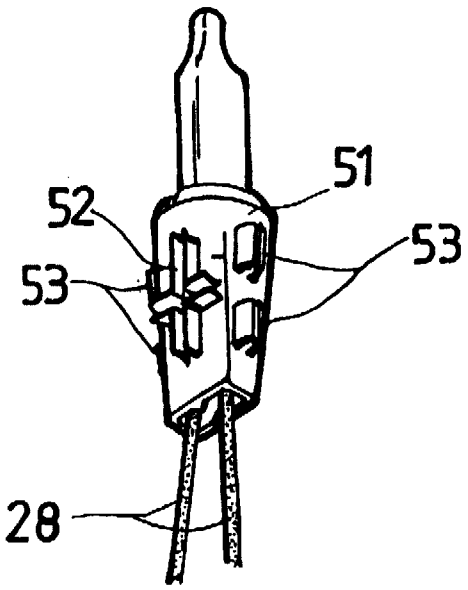
FIG. 10 is an enlarged, fragmentary, perspective view showing the lamp holder of FIG. 9 before being attached to the net.
Figure 9:
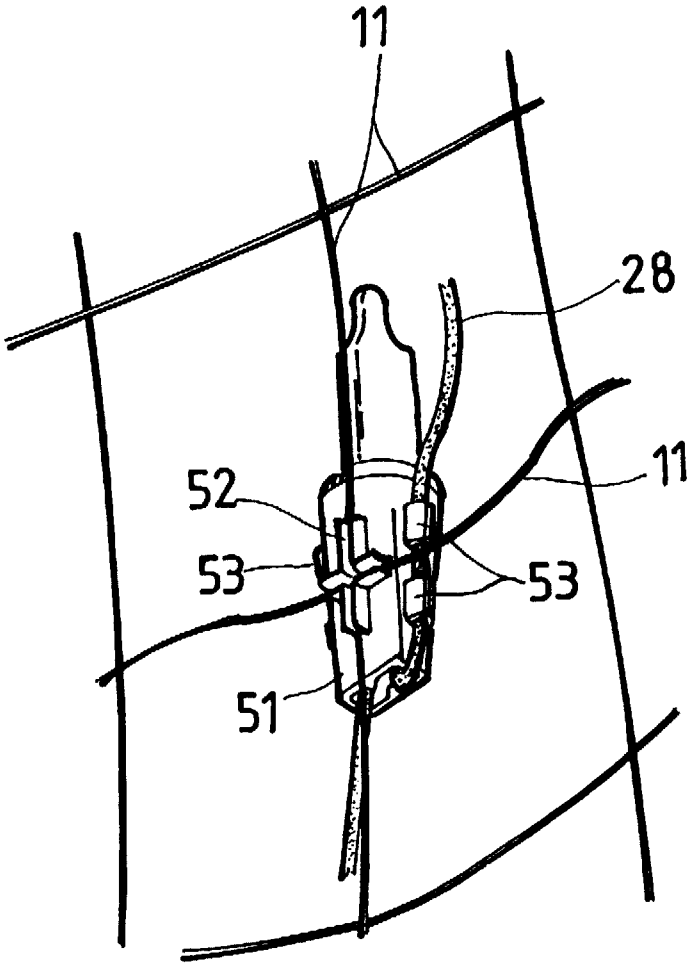
FIG. 9 is another enlarged, fragmentary, perspective rear view of FIG. 4 showing the lamp holder in the lit string being associated with the net in another manner.

FIGS. 9 and 10 show a lamp holder 51 being provided with another type of binding means. This type of binding means includes a cross-shaped clamping means 52 for clamping a length of net string 11 therein. Due to the special cross shape, this type of clamping means 52 is particularly suitable for fixing a lamp holder 51 to a joint of a horizontal and a vertical net strings 11. Of course, it can also be conveniently and effectively used to fix the lamp holder 51 to either a horizontal or a vertical net string 11. The bind means of this type also includes a wire guiding means 53 provided to one side of the lamp holder 51 to conveniently route the wire 28. This type of binding means allows the lit string 2 to be more easily attached to the net 1.

FIGS. 11 and 12 show a lamp holder 61 being provided with a binding means including an L-shaped belt 62 and a catcher 63, and a guiding channel 64. A free end of the L-shaped belt 62 is a half-arrow shaped head 63 which may be fitly extended through the catcher 63 to pass across the guiding channel 64, so as to confine a length of wire 65 and net string 11 in the guiding channel 64, as shown in FIG. 13.

Figure 14:
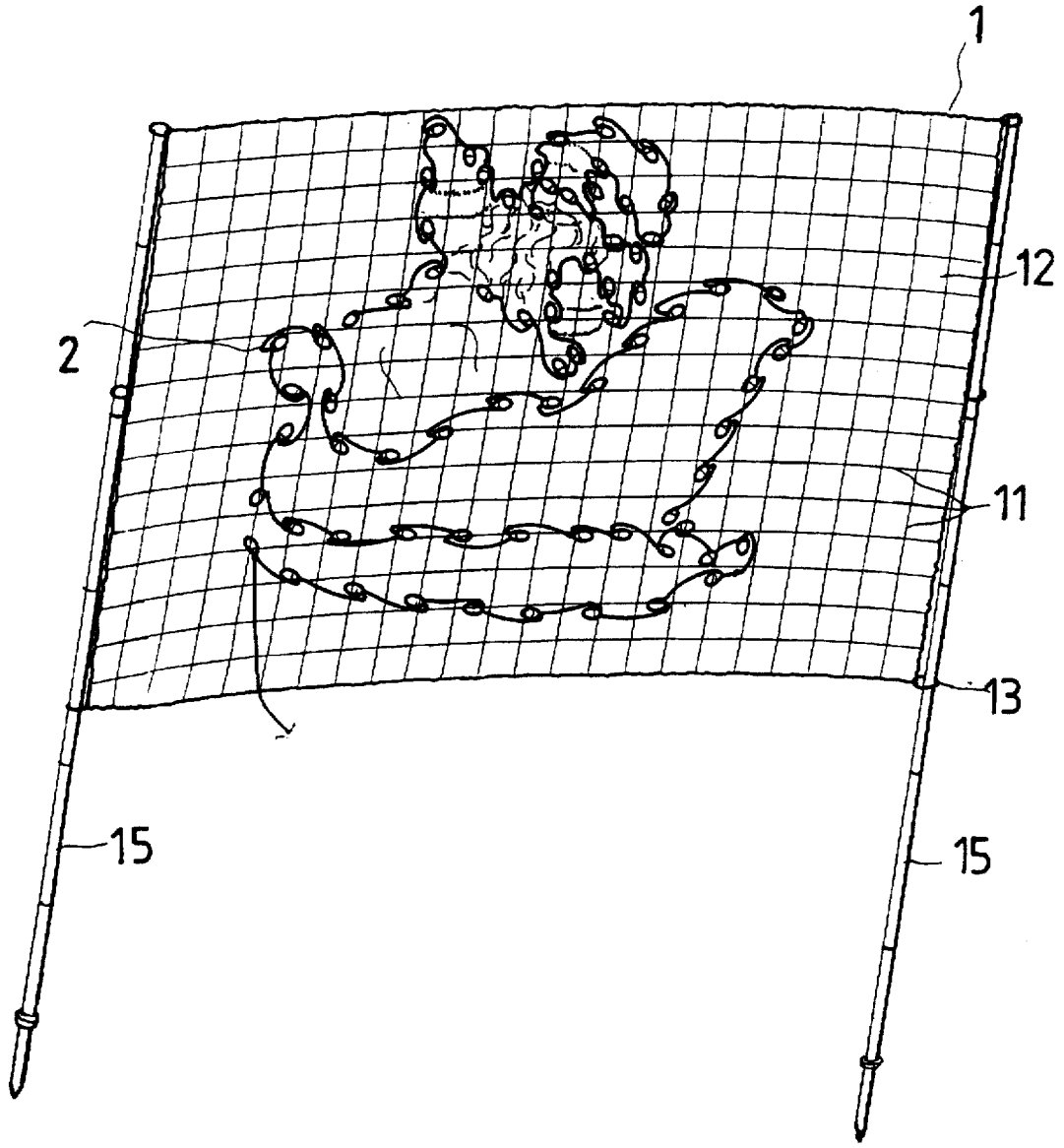
FIG. 14 shows the design formed from the present invention being supported on posts for erecting in an outdoor garden.

The present invention can be used in different places. Loops 13 may be provided to an outer periphery of the net 1. When the net 1 is spread, it can be hung on a wall, a door leaf, a window by hanging the loops 13 on hooks or nails already mounted on the wall, door or window. Or, the net 1 can be supported on two rigid posts 15 as shown in FIG. 14, by extending the posts through two sides of the net, so that the whole net 1 and posts 15 can be erected outdoors in a garden or on a roof.

Since the lit string 2 and the net 1 all are soft articles, they can be folded into a very small volume for packing, transportation, or storage purpose. What is more important is all the lamps in the lit string 2 are open on the net 1 and can be easily accessed. Any burned lamp can be directly removed from the lit string and the net and replaced with a new one. The lit string 2 can therefore be conveniently maintained.

What is claimed is:

1. A lit string structure for easy formation of patterns, particularly suitable for use in Christmas season and in the night as a decoration or an advertising means, comprising:

a net woven from soft strings to form a plurality of openings on the net;

at least one set of lit string including a plurality of lamp holders with lamps and serially connected together by electric wires, each said lamp holder being provided with means for binding said electric wires and clamping said net strings, so that said at least one set of lit string can be fixed onto said net according to a predetermined design or pattern; and control means connected to a plug which can be plugged into a socket to obtain power for said control means to control lighting, extinguishing, and flashing of said lamps on said at least one set of lit string.

2. A lit string structure for easy formation of patterns as claimed in claim 1, wherein said means for binding said electric wires and net strings each includes at least a long belt having a toothed inner surface and a catcher, said long belt being extended through said catcher to enclose a length of said electric wire and/or said net string in said binding means, so as to associate said lamp holder with said net.

3. A lit string structure for easy formation of patterns as claimed in claim 2, wherein said lamp holder is further provided with clamping means for clamping and thereby locating said electric wires and/or said net strings in place.

4. A lit string structure for easy formation of patterns as claimed in claim 2, wherein said catcher of said binding means on each said lamp holder includes an outer wall portion and a toothed inner block opposite to said outer wall portion, whereby when said long belt is extended through said catcher between said outer wall portion and said toothed block, said toothed inner surface of said long belt engages with said toothed block to retain said long belt in said catcher.

5. A lit string structure for easy formation of patterns as claimed in claim 1, wherein said binding means includes a cross-shaped clamping means for clamping and locating said electric wires and said net strings therein to associate said lamp holder with said net.

6. A lit string structure for easy formation of patterns as claimed in claim 5, wherein each said lamp holder is provided at one side with an electric wire guiding channel for clamping a length of said electric wires therein to route said electric wire.

7. A lit string structure for easy formation of patterns as claimed in claim 1, wherein said binding means on each lamp holder includes an L-shaped belt and a catcher, said L-shaped belt having a free end which is a half-arrow shaped head for fitly extending through said catcher, said L-shaped belt also extending across a long channel formed on an outer surface of said lamp holder, and said long channel being used to route said electric wires and said net strings.

8. A lit string structure for easy formation of patterns as claimed in claim 1, further comprising a pair of rigid posts for extending through two sides of net to spread and erect said net outdoors.

9. A lit string structure for easy formation of patterns as claimed in claim 1, wherein said net is printed with a predetermined design or pattern, so that said lit string can be conveniently attached to said net by following said design or pattern printed on said net.

* * * * *